US007521639B1

(12) United States Patent
Ward

(10) Patent No.: US 7,521,639 B1
(45) Date of Patent: Apr. 21, 2009

(54) SAFETY SWITCH

(75) Inventor: Charles Barry Ward, Alpharetta, GA (US)

(73) Assignee: Diversitech Corporation, Duluth, GA (US)

( * ) Notice: Subject to any disclaimer, the term of this patent is extended or adjusted under 35 U.S.C. 154(b) by 0 days.

(21) Appl. No.: 11/737,243

(22) Filed: Apr. 19, 2007

Related U.S. Application Data

(60) Provisional application No. 60/745,537, filed on Apr. 25, 2006.

(51) Int. Cl.
*H01H 35/18* (2006.01)

(52) U.S. Cl. ..... 200/84 R; 200/81.9 R

(58) Field of Classification Search ..... 200/84 R
See application file for complete search history.

(56) References Cited

U.S. PATENT DOCUMENTS 4,080,985 A * 3/1978 Eagle ..... 137/429
5,010,218 A * 4/1991 Reimers ..... 200/84 R
5,281,858 A * 1/1994 Langved ..... 307/118
6,730,865 B1 * 5/2004 Hernandez-Zelaya ..... 200/84 R

OTHER PUBLICATIONS

The web site for Resource Conservation Technologies, Inc. found at http://www.aquaguardusa.com/index.html, elaborating on the AquaGuard AG-1, Sep. 11, 2007.

* cited by examiner

*Primary Examiner*—Elvin G Enad
*Assistant Examiner*—Lheiren Mae A Anglo
(74) *Attorney, Agent, or Firm*—Smith, Gambrell & Russell LLP

(57) ABSTRACT

A safety switch for sensing the level of water in a condensate pan has a molded plastic body with an attachment section and a float probe. The attachment section includes a collar that fits over and connects to the side edge of the condensate pan. The float probe comprises a hollow elongated housing with a grille opening to allow entry of water. A float, position within the hollow elongated housing, moves in response to entry of water into the elongated housing. The float includes a magnet that activates a reed switch mounted in a watertight compartment extending along one wall of the elongated housing. The float probe may be fixedly or adjustably attached to the molded body of the safety switch. For adjustable attachment, the float probe is snugly fit into the opening of a yoke so that the float probe can be raised or lowered or inclined with respect to the yoke.

14 Claims, 9 Drawing Sheets

SAFETY SWITCH

CLAIM OF PRIORITY

This application claims priority from U.S. Provisional Patent Application Ser. No. 60/745,537 filed on Apr. 25, 2006, which is incorporated herein in its entirety.

FIELD OF THE INVENTION

This invention relates to a safety switch for detecting a high water condition in a condensate pan of a heating, ventilating, and air-conditioning (HVAC) system.

BACKGROUND OF THE INVENTION

A safety switch is used in an HVAC system to monitor the water level in the condensate pan of the HVAC system. The safety switch typically comprises a body with a float mechanism to determine the level of water in the condensate pan. The float is connected to a switch. When the drain of the condensate pan is clogged and the water level exceeds a certain predetermined level, the float activates the switch to sound an alarm and/or to shut off the HVAC system.

Such a safety switch is often located in an extreme environment and subjected to moisture, heat, and cold. Consequently, the safety switch must be designed to function reliably in such an environment and to require minimum maintenance. Further, the safety switch must be rugged and easy to installed. The safety switch must also be adjustable to accommodate condensate pans of difference sizes and shapes.

SUMMARY OF THE INVENTION

The present invention addresses the issues raised concerning the construction, operation, and maintenance of a safety switch. The safety switch of the present invention is simple in construction, reliable in operation, adjustable, easy to install, and virtually maintenance free.

In order to achieve the objects outlined above, the safety switch of the present invention comprises a molded plastic body with an attachment section and a float probe. The attachment section includes a collar that fits over the side edge of the condensate pan. Two screws secure the collar to the edge of the condensate pan. The float probe comprises a hollow elongated housing with a grille opening at its lower end to allow entry of water but not debris. A float is position within the hollow elongated housing of the float probe for free movement up and down in response to entry of water into the elongated housing through the grille opening at the lower end. The float includes a magnet. A reed switch is mounted in a watertight compartment extending along one wall of the elongated housing. When the float carries the magnet to a predetermined elevation within the elongated housing, the magnet causes the reed switch to open thus signaling to control circuitry to sound an alarm and/or shut off the HVAC system.

In the one embodiment, the float probe is fixedly attached to the molded body of the safety switch. In another embodiment, the float probe is attached to the molded body of the safety switch by means of a yoke with an opening. Particularly, in the alternative embodiment the float probe is snugly fit into the opening of the yoke so that the float probe can be raised, lowered, or inclined with respect to the yoke. Once properly position, friction between the yoke and the float probe holds the float probe in the selected position. Consequently, the float probe can be properly position in the of condensate pan for best operation. Alternatively, the float probe may be pivotally mounted to the yoke for swivel adjustment without vertical adjustment.

Further objects, features and advantages will become apparent upon consideration of the following detailed description of the invention when taken in conjunction with the drawings and the appended claims.

DETAILED DESCRIPTION OF THE PREFERRED EMBODIMENT

Figure 1:
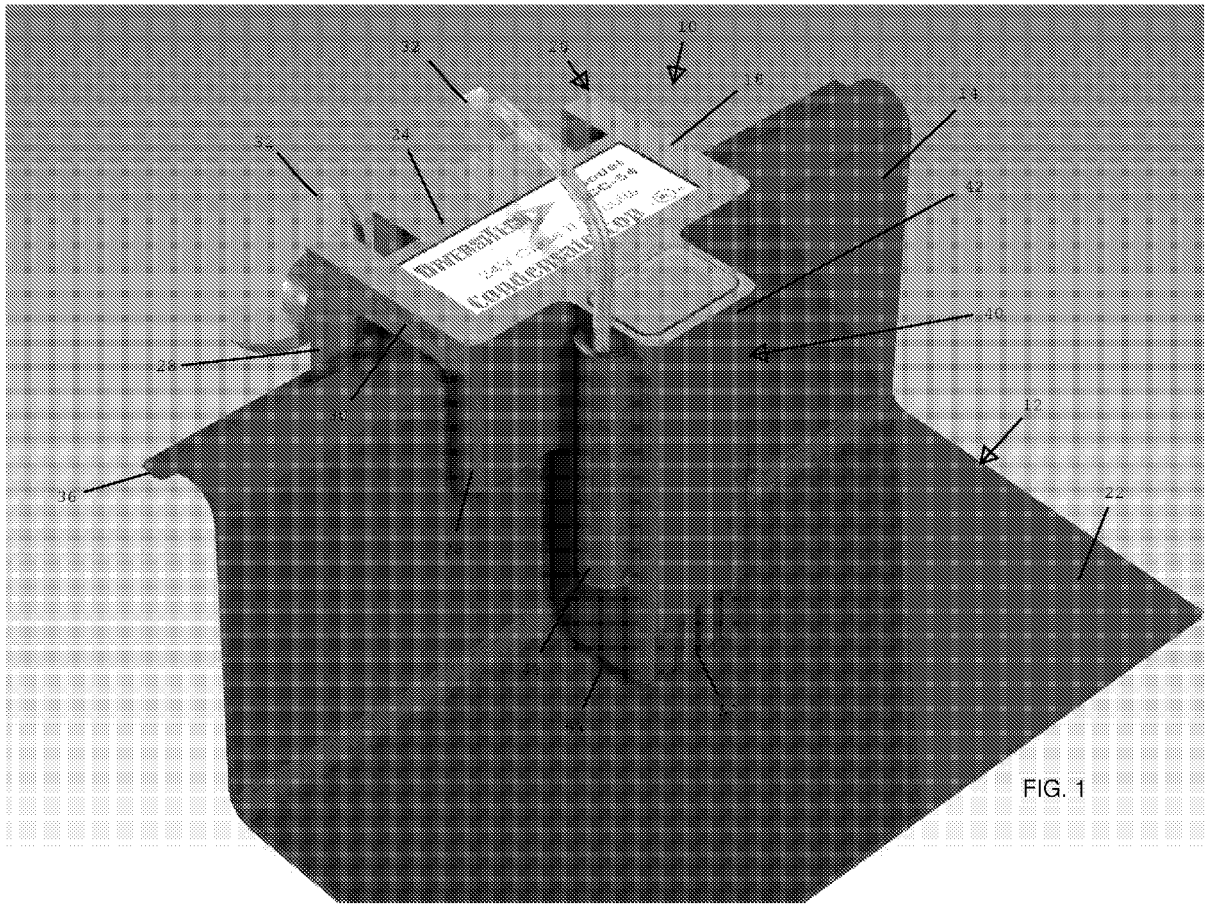
FIG. 1 is a front perspective view of a first embodiment of the safety switch in accordance with the present invention.
Figure 2:
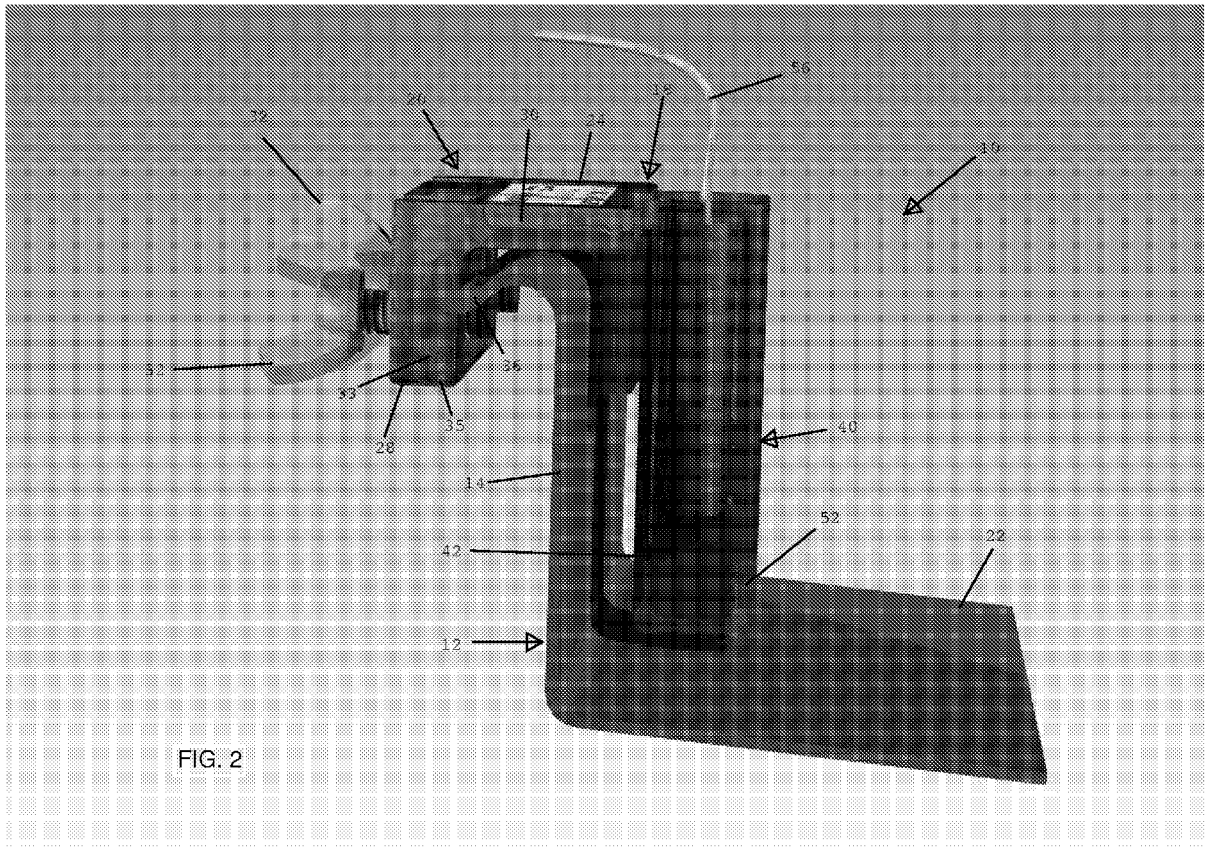
FIG. 2 is a side elevation view, partially cut away, of the first embodiment of the safety switch in accordance with present invention.
Figure 3:
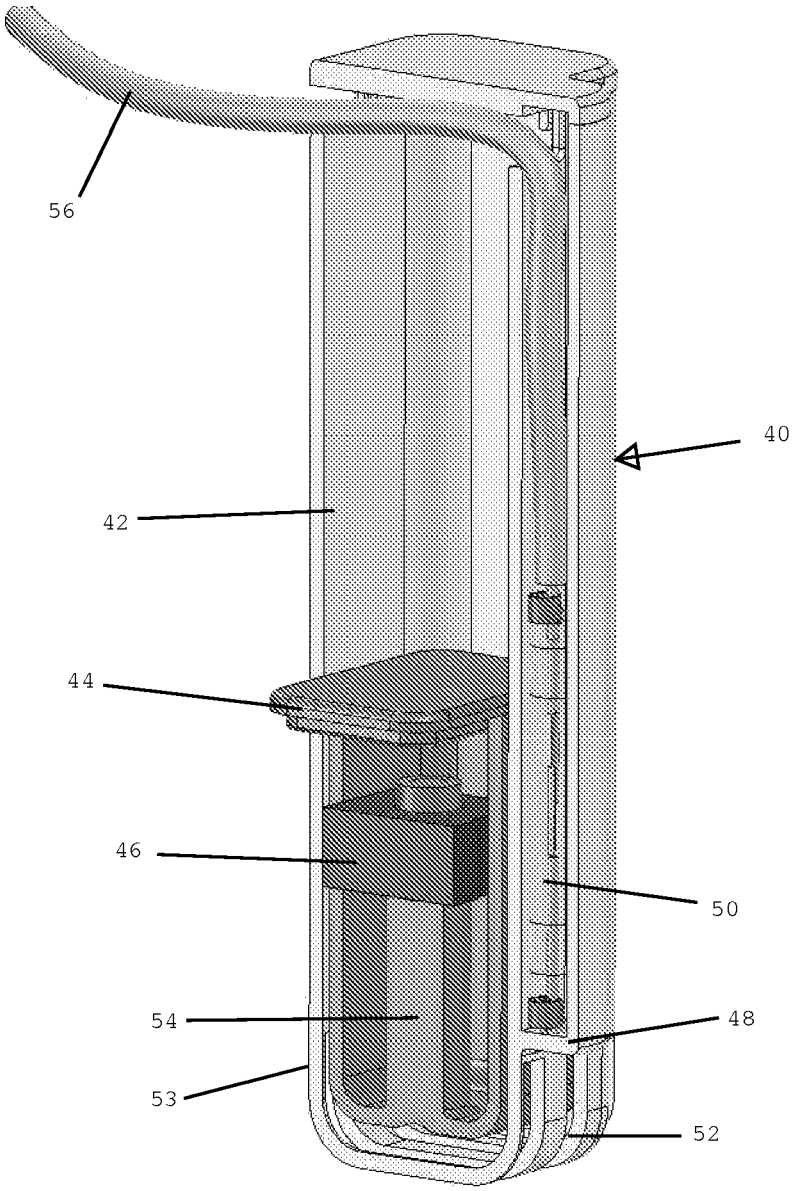
FIG. 3 is a detailed cut away view of the internal construction of the float probe used in connection with the first embodiment of the safety switch in accordance with the present invention.
Figure 4:
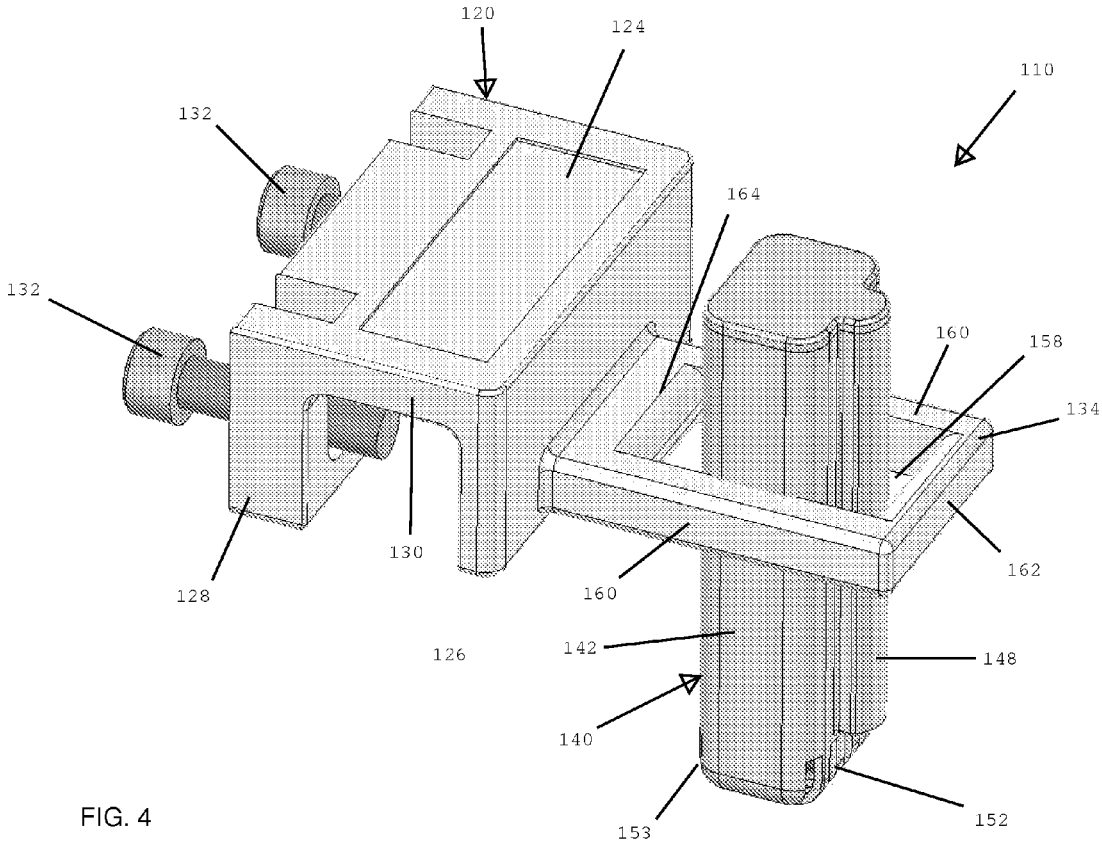
FIG. 4 is a top perspective view of a second embodiment of the safety switch in accordance with the present invention.
Figure 5:
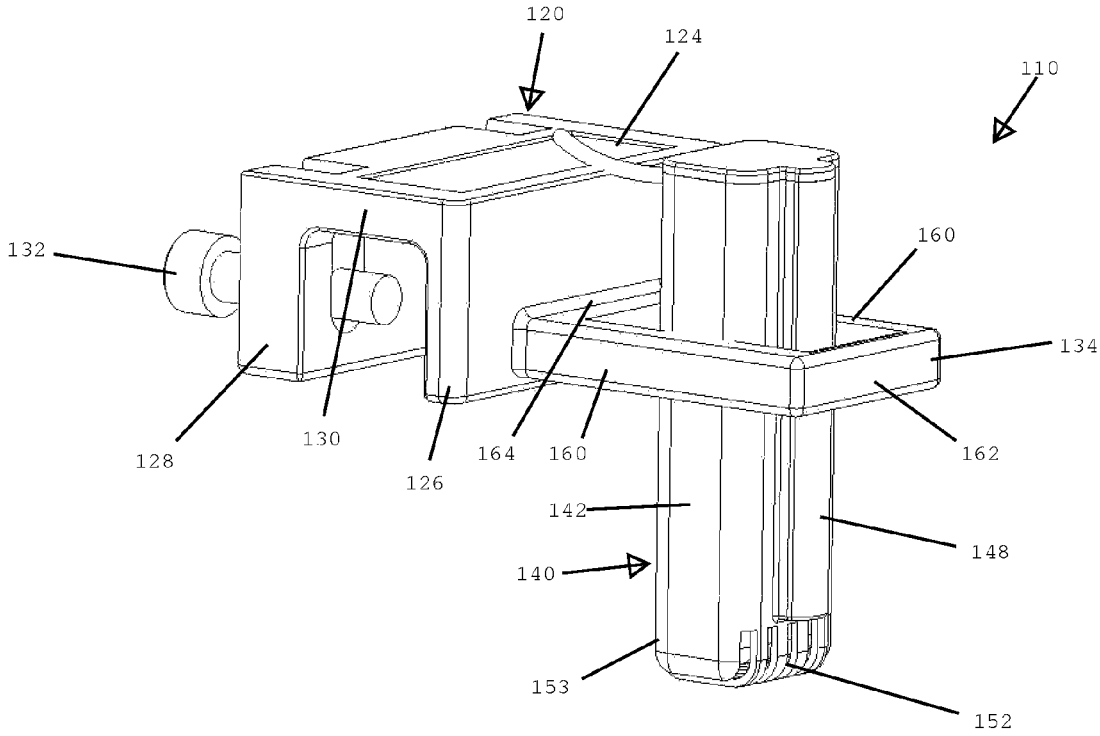
FIG. 5 is a front perspective view of the second embodiment of the safety switch in accordance with the present invention.
Figure 6:
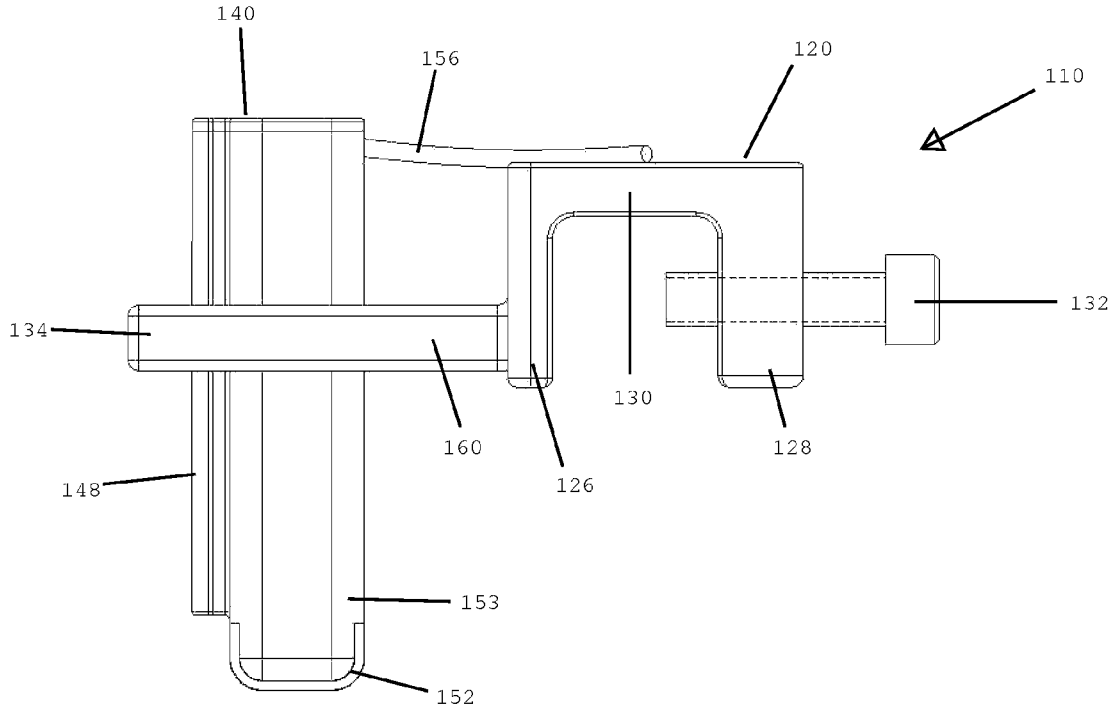
FIG. 6 is a side elevation in view of the second embodiment of the safety switch in accordance with the present invention.
Figure 7:
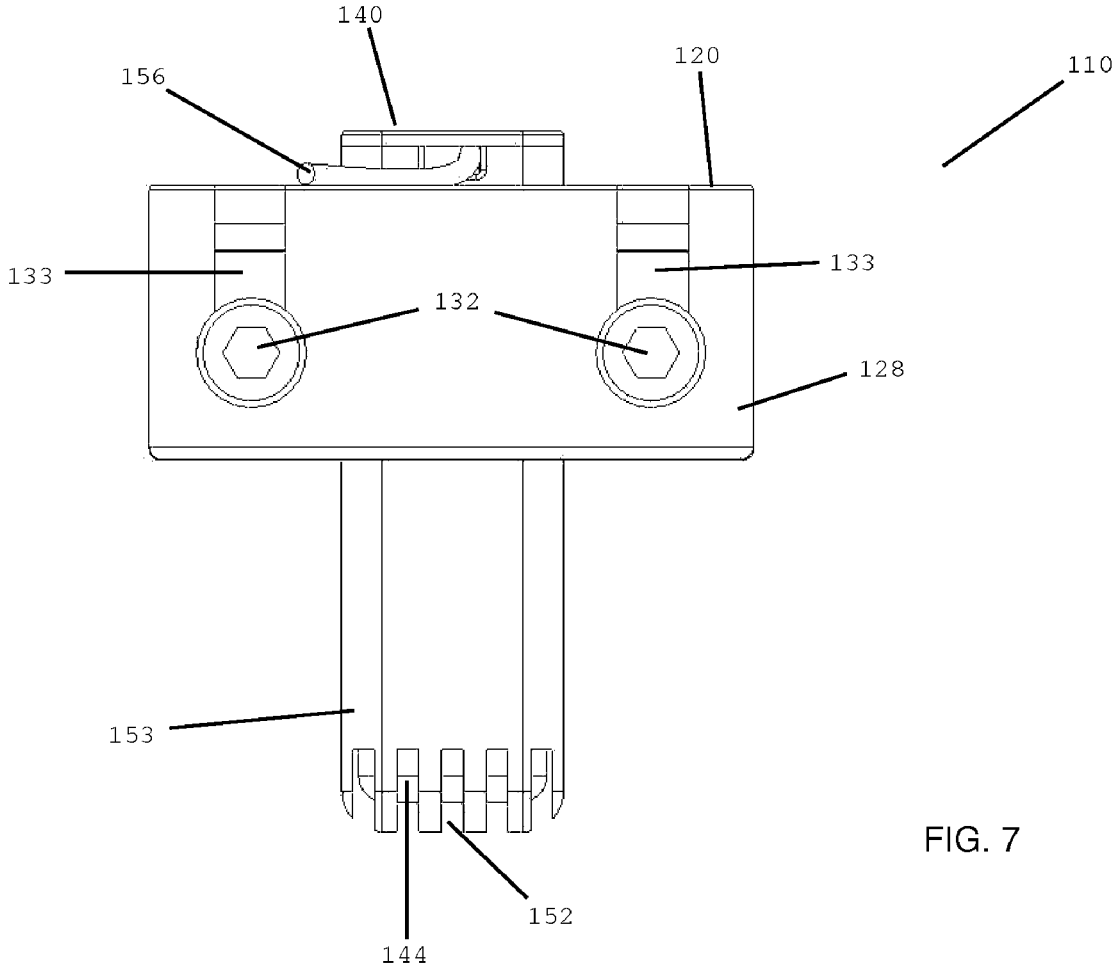
FIG. 7 is a back elevation view of the second embodiment of the safety switch in accordance with the present invention.
Figure 9:
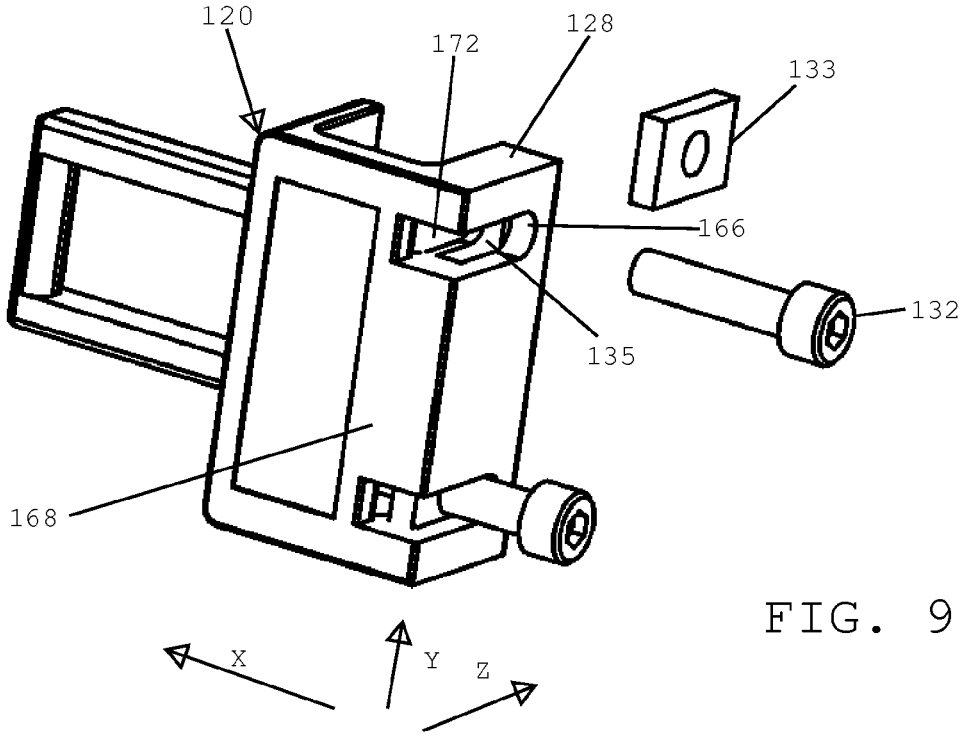
FIG. 9 is a top perspective view of the attachment section of the second embodiment of the safety switch in accordance with the present invention.
Figure 10:
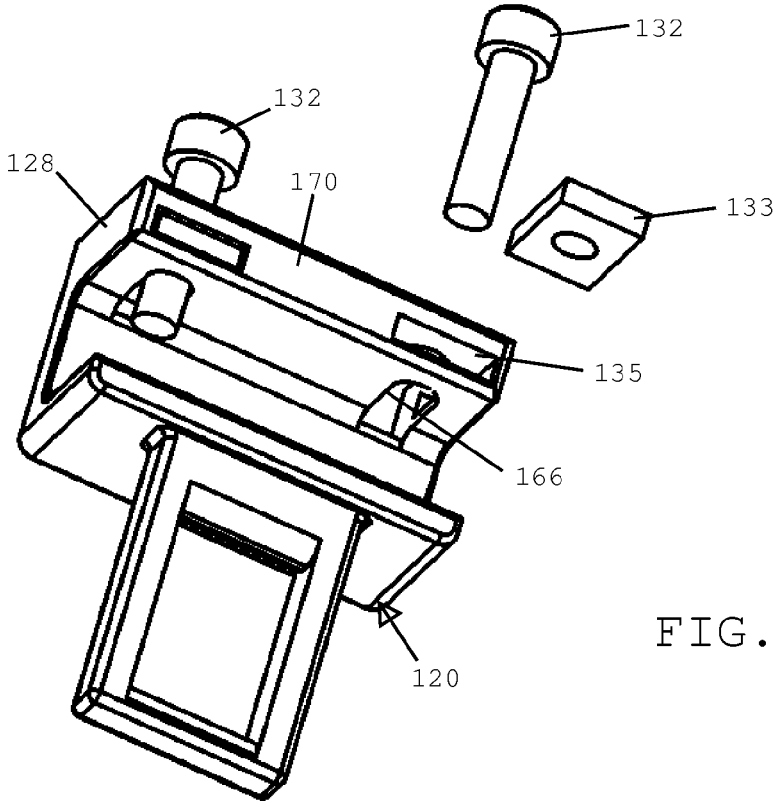
FIG. 10 is a bottom perspective view of the attachment section of the second embodiment of the safety switch in accordance with the present invention.

Turning to FIGS. 1, 2, and 3, a first embodiment of a safety switch 10 is shown. The safety switch 10 is mounted on a side edge 14 of a condensate pan 12 to sense the level of water in the condensate pan 12. The safety switch 10 comprises a molded plastic body 18 consisting of an attachment section 20 and a float probe 40. The float probe 40 is fixedly connected to the attachment section 20. The attachment section 20 comprises a U-shaped collar 24 including a first leg 26, a second leg 28, and a throat section 30. The second leg 28 has a pair of nut slots 35. Each of the slots 35 retains a flat nut 33. A clamping screw 32 is threaded into each of the flat nuts 33. The clamping screws 32 secure the molded body 18 of the safety switch 10 on the edge 14 of the condensate pan 12. The nut slots 35 and related structure will be described in greater detail in connection with nut slots 135 of the second embodiment of the invention (FIGS. 9-10).

The float probe 40 comprises a hollow elongated housing 42 extending from near the bottom 22 of the condensate pan 12 to near the top edge 14 of the condensate pan 12. The elongated housing 42 is hollow and has grille openings 52 at its lower end 53 adjacent the bottom 22 of the condensate pan 12. The grille openings 52 allow the water in the condensate pan 12 to enter into the hollow elongated housing 42, but preclude the entry of debris into the hollow elongated housing 42.

As best seen in FIG. 3, a float 44 is disposed within the hollow elongated housing 42 and is free to slide up and down within the hollow elongated housing 42. The float 44 floats up and down on the water within the hollow elongated housing 42 as the water in the condensate pan 12 rises and falls. The float 44 includes a permanent magnet 46 attached to a pedestal 54 within the float 44. A watertight compartment 48 extends along one side of the hollow elongated housing 42. A normally closed reed switch 50 is mounted within the compartment 48. When the float 44 rises in response to water entering the hollow elongated housing 42 through the grille openings 52, the proximity of the magnet 46 to the reed switch 50 causes the normally closed reed switch 50 to open. The opening of the reed switch 50 sends a control signal through the control wire 56 to control circuitry (not shown) to sound an alarm and/or to shut off the HVAC system. In addition to the combination of the reed switch 50 and the magnet 46, a capacitance switch or other sealed switch may be used. Regardless of the type of switch employed, the switch is enclosed in the watertight compartment 48 so that the contacts of the switch are not subjected to the environment in the condensate pan 12.

Turning to FIG. 2, the throat section 30 of the U-shaped collar 24 of the safety switch 10 is dimensioned so that the attachment section 20 can span the edge 14 of the condensate pan 12. Likewise, the clamping screws 32 are sufficiently long to allow engagement of a condensate pan 12 having a lip 36 as shown in FIG. 2 or a metal condensate pan 12 that does now have a lip. Consequently, the attachment section 20 can engage a variety of condensate pans 12.

Turning to FIGS. 4-8, a second embodiment of a safety switch 110 is shown. The safety switch 110 can be mounted on the side edge 14 of the condensate pan 12 (such as in FIG. 1) to sense the level of water in the condensate pan 12. The safety switch 110 comprises a molded plastic body 118 consisting of an attachment section 120 and a float probe 140. The float probe 140 is connected to the attachment section 120 by means of a yoke 134. The attachment section 120 comprises a U-shaped collar 124 including a first leg 126, a second leg 128, and a throat section 130. A clamping screw 132 is threaded into each of the flat nuts 133. The clamping screws 132 secure the molded body 118 of the safety switch 110 on the edge 14 of the condensate pan 12.

Figure 8:
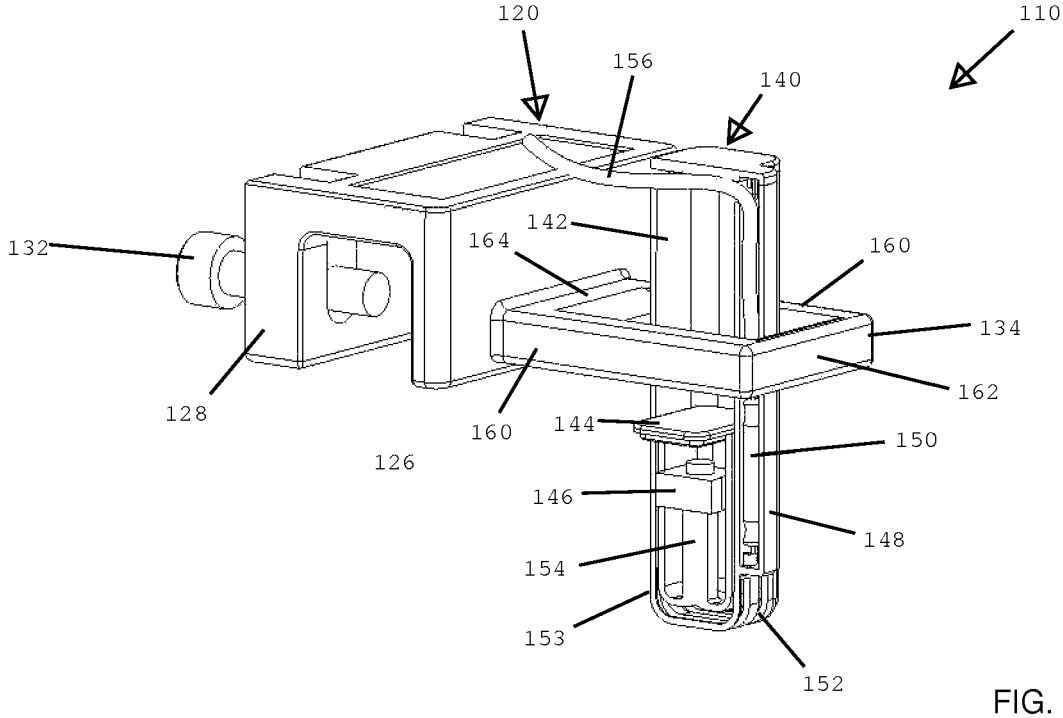
FIG. 8 is a front perspective view, partially cut away, of the second embodiment of the safety switch in accordance with the present invention.

The float probe 140 is essentially the same as the float probe 40 shown in FIG. 3 and previously described. Turning to FIG. 8, the flow probe 140 comprises a float 144 contained within the hollow elongated housing 142. The flow 144 is free to slide up and down within the hollow elongated housing 142. The float 144 floats up and down on the water within the hollow elongated housing 142 as the water in the condensate pan 12 rises and falls. The float 144 includes a permanent magnet 146 attached to a pedestal 154 within the float 144. A watertight compartment 148 extends along one side of the hollow elongated housing 142. A normally closed reed switch 150 is mounted within the compartment 148. When the float 144 rises in response to water entering the hollow elongated housing 142 through the grille openings 152, the proximity of the magnet 146 to the reed switch 150 causes the normally closed reed switch 150 to open. The opening of the reed switch 150 sends a control signal through the control wire 156 to control circuitry (not shown) to sound an alarm and/or to shut off the HVAC system. In addition to the combination of the reed switch 150 and the magnet 146, a capacitance switch or other sealed switch may be used. Regardless of the type of switch employed, the switch is enclosed in the watertight compartment 148 so that the contacts of the switch are not subjected to the environment in the condensate pan 12.

As previously indicated, the flow probe 140 is connected to the attachment section 120 by means of the yoke 134. The yoke 134 is rectangular in shape with sides 160, proximal end 162, and distal end 164 which define a rectangular opening 158. The proximal end 162 is connected to the attachment section 120. The rectangular opening 158 is dimensioned so that the float probing 140 snugly fits between the sides 160 of the opening 158 and is captured by the friction between at the outside walls of the float probe 140 and the sides 160 of the opening 158. Thus captured, the flow probe 140 can be adjusted up and down with respect to yoke 134 and can be inclined with respect to the sides 160. Such an adjustment of height and inclination allows the float probe 140 to be located in the best position for measuring the water level in the condensate pan 12.

Another feature of the present invention is the manner in which the attachment section 120 is constructed. Particularly, the configuration of the second leg 128 of the U-shaped collar 124, and the use of the flat nut 133 with the clamping screws 132, allows for the attachment section 120 to be molded in a simple A-B molding operation without the need for movable mold cores or slides. The details of the attachment section 120 are shown in FIGS. 9 and 10.

In order to provide an opening 172 through the second leg 128 in the X-direction as shown in FIGS. 9 and 10, the second leg 128 is molded with two intersecting slots, a nut slot 135 and a screw slot 166. The nut slot 135 extents from the bottom 170 of the second leg 128 in the Z-direction and terminates short of the top 168 of the second leg 128. The screw slot 166 extents from the top 168 of the second leg 128 in the Z-direction and terminates short of the bottom 170 of the second leg 128. The intersecting slots 135 and 166 thus form an opening 172 through the second leg 128 in the X-direction to accommodate the screw 132. The flat nut 133 is inserted into the nut slot 135 from the bottom 170 of the second leg 128. The screw 132 is inserted in the X-direction and engages the nut 133 to hold the nut 133 in the nut slot 135. Because the nut slot 135 is open on the bottom 170 of the second leg 128 and because the screw slots 166 is open on the top 168 of the second leg 128, the slots can be molded in a simple A-B molding operation without the need for movable a core or slide to create the opening 172 in the X-direction.

While this invention has been described with reference to preferred embodiments thereof, it is to be understood that variations and modifications can be affected within the spirit and scope of the invention as described herein and as described in the appended claims.

I claim:

1. A safety switch for sensing the level of water in a condensate pan comprising:

a. an attachment section for attaching the safety switch to an edge of the condensate pan; and b. a float probe connected to the attachment section for extension into the condensate pan and comprising:

i. a hollow elongated housing with a float movable therein;

ii. an inlet opening for allowing water in the condensate pan to flow into the hollow elongated housing; and iii. a switch mounted in a separate watertight compartment adjacent the elongated housing, wherein the switch is not subject to the environment in the condensate pan, wherein movement of the float in the hollow elongated housing activates the switch to sense the level of water in the condensate pan and wherein the float probe is adjustably connected to the attachment section so that the float probe can be adjusted to a desired level and inclination with respect to the attachment section and thereby the float probe can be located at a desired level and inclination within the condensate pan.

2. The safety switch of claim 1, wherein the inlet opening of the float probe has a grille for restricting the admission of debris into the hollow housing.

3. The safety switch of claim 1, wherein the adjustment section comprises a U-shaped collar, wherein one leg of the U-shaped collar has a slot arrangement for retaining a flat nuts and wherein a screw engages the flat nut for securing the safety switch to the edge of the condensate pan.

4. The safety switch of claim 3, wherein the slot arrangement includes a series of offset slots so that a through opening is created for the screw to extend through the one leg.

5. A safety switch for sensing the level of water in a condensate pan comprising:

a. an attachment section for attaching the safety switch to an edge of the condensate pan; and b. a float probe connected to the attachment section for extension into the condensate pan and comprising:

i. a hollow elongated housing with a float movable therein and wherein the float has an actuator attached thereto;

ii. an inlet opening for allowing water in the condensate pan to flow into the hollow elongated housing; and iii. a switch mounted in a separate watertight compartment adjacent the elongated housing and restrained by the watertight compartment from physically contacting the float, wherein movement of the float in the hollow elongated housing causes the switch to open and to close in response to the actuator on the float without physical contact between the actuator and the switch, and thereby sense the level of water in the condensate pan.

6. The safety switch of claim 5, wherein the float probe is adjustably connected to the attachment section so that the float probe can be located at a desired level and inclination within the condensate pan.

7. The safety switch of claim 5, wherein the inlet opening of the float probe has a grille for restricting the admission of debris into the hollow housing.

8. The safety switch of claim 5, wherein the adjustment section comprises a U-shaped collar, wherein one leg of the U-shaped collar has a slot arrangement for retaining a flat nut, and wherein a screw engages the flat nut for securing the safety switch to the edge of the condensate pan.

9. The safety switch of claim 8, wherein the slot arrangement includes a series of offset slots so that a through opening is created for the screw to extend through the one leg.

10. A safety switch for sensing the level of water in a condensate pan comprising:

a. an attachment section for attaching the safety switch to an edge of the condensate pan; and b. a float probe connected to the attachment section for extension into the condensate pan and comprising:

i. a hollow elongated housing with a float movable therein;

ii. an inlet opening for allowing water in the condensate pan to flow into the hollow elongated housing; and iii. a switch adjustable mounted in a separate elongated watertight compartment that is adjacent the elongated housing and the separate elongated watertight compartment extends along the length of the hollow elongated housing so that the switch can be adjusted within the separate watertight compartment and thereby along the length of the hollow elongated housing, wherein movement of the float in the hollow elongated housing activates the switch to sense the level of water in the condensate pan.

11. The safety switch of claim 10, wherein the float probe is adjustably connected to the attachment section so that the float probe can be located at a desired level and inclination within the condensate pan.

12. The safety switch of claim 10, wherein the inlet opening of the float probe has a grille for restricting the admission of debris into the hollow housing.

13. The safety switch of claim 10, wherein the adjustment section comprises a U-shaped collar, wherein one leg of the U-shaped collar has a slot arrangement for retaining a flat nut, and wherein a screw engages the flat nut for securing the safety switch to the edge of the condensate pan.

14. The safety switch of claim 13, wherein the slot arrangement includes a series of offset slots so that a through opening is created for the screw to extend through the one leg.

* * * * *